United States Patent [19]

Kohlen

[11] Patent Number: 4,570,867

[45] Date of Patent: Feb. 18, 1986

[54] DEVICE FOR SUCKING-UP AND HOLDING A THREAD

[75] Inventor: Karl-Heinz Kohlen, Monchen-Gladbach, Fed. Rep. of Germany

[73] Assignee: W. Schlafhorst & Co., Monchen-Gladbach, Fed. Rep. of Germany

[21] Appl. No.: 520,721

[22] Filed: Aug. 5, 1983

[30] Foreign Application Priority Data

Aug. 6, 1982 [DE] Fed. Rep. of Germany ..... 3229329

[51] Int. Cl.[4] ..... B65H 54/22; B65H 67/08

[52] U.S. Cl. ..... 242/35.6 R; 242/35.6 E

[58] Field of Search ..... 242/35.6 E, 35.6 R, 242/35.5 R; 226/97; 57/305

[56] References Cited

U.S. PATENT DOCUMENTS

| | | | |
|---|---|---|---|
| 2,743,877 | 5/1956 | Furst | 242/35.6 R |
| 3,136,494 | 6/1964 | Furst | 242/35.6 E |
| 3,203,634 | 8/1965 | Furst | 242/35.6 E |
| 3,261,562 | 7/1966 | Kupper | 242/35.6 R |
| 3,377,031 | 4/1968 | Raasch et al. | 242/35.6 E |
| 3,608,843 | 9/1971 | Siedlich | 242/35.6 E |
| 4,036,444 | 7/1977 | Suter | 242/35.6 E |

*Primary Examiner*—Stanley N. Gilreath

*Attorney, Agent, or Firm*—Herbert L. Lerner; Laurence A. Greenberg

[57] ABSTRACT

Device for sucking-in and holding a thread, including a suction body having a suction opening formed therein for sucking-in a thread, and a controllable thread-clamping device for clamping the thread sucked-in through the opening, the thread-clamping device being in the form of pneumatic value operated by suction air.

7 Claims, 4 Drawing Figures

DEVICE FOR SUCKING-UP AND HOLDING A THREAD

The invention relates to a device for sucking-up and holding a thread, with a suction opening and a controllable thread clamping device.

Such devices have already been used in automatic tying devices. The thread-clamping device is actuated mechanically in these devices, such as by allowing a lid which resiliently closes off the suction opening, to run against a stop when approaching the thread. In this way the suction opening is opened, and only then does suction air start to act on the thread.

The measures required for opening and closing the controllable thread-clamping device, such as flexible cables or stop mechanisms, are rather expensive and trouble-prone. Since the under-pressure is present continuously, sealing problems are also present. It is accordingly an object of the invention to provide a device for sucking-up and holding a thread, which overcomes the hereinafore-mentioned disadvantages of the heretofore-known devices of this general type, is of simple construction, requires no control mechanisms and is operationally reliable.

With the foregoing and other objects in view there is provided, in accordance with the invention, a device for sucking-in and holding a thread, comprising a suction body having a suction opening formed therein for sucking-in a thread, and a controllable thread-clamping device for clamping the thread sucked-in through the opening, the thread-clamping device being in the form of a pneumatic valve operated by suction air or under pressure.

The pneumatic valve may respond to the underpressure either directly or indirectly in the form of a servo valve. In both cases, the valve opens only if the underpressure is present and a thread can actually also be sucked-up.

In order to prevent a thread or thread end having to travel an extended distance before it reaches the thread-clamping device, which would at best result in a loss of time, the pneumatic valve is advantageously disposed in vicinity of the suction opening. This condition is met also if the pneumatic valve is located immediately at the suction opening.

In accordance with another feature of the invention there is provided a valve seat, and a valve disc of the pneumatic valve being spring-loaded against the valve seat and being lifted off the valve seat by suction air or underpressure. The lifting therefore proceeds in the flow direction. The flow conditions are particularly advantageous if, according to a further feature of the invention the valve disc is conical and is tapered against the direction of flow of the suction air or underpressure. With this shape of the valve disc, the sucked-up thread is accelerated in any case in the direction toward the opened valve gap. Furthermore, the thread cannot easily stick to the valve disc.

In accordance with an additional feature of the invention, the suction body is a suction head in which the suction opening is formed, and the valve seat is part of the suction head. Industrial production is simplified in this way. This suction head forms a special assembly which can be connected to suction devices of quite different construction.

In accordance with an added feature of the invention, there is provided a suction air source, a controllable valve connected to the suction air source, and a hollow body connected from the controllable valve to the suction head. The hollow body may be a hose or advantageously, a movable line.

It is not necessary to keep the suction head or the device in continuous readiness in vicinity of a thread. The device picking up the thread may also be a traveling device. Even in the case of a stationary device, it is not always necessary to keep a suction head or the like in readiness in proximity of the thread. Therefore, in accordance with yet another feature of the invention, the hollow body is a movable or swivelable line. Swiveling pipelines are used, for instance, in thread-tying devices. In such machines, control devices are already provided which can be utilized for controlling the device according to the invention.

In accordance with yet a further feature of the invention, the suction body and controllable thread-clamping device are part of an automatic thread-joining device. Such a thread-tying device may be a knotting device or a splicing device. In both cases, thread ends are to be joined together. The device according to the invention for sucking-up and holding the thread is highly suited for preparing such a thread connection.

The advantages obtained with the invention are in particular that several activities can be assigned to one end and the same device. The thread is first sucked-up by a suction air pulse or by suction air present for a limited period of time. After the suction air action ceases the thread is held. The suction head holding the thread can then be subjected to a controlled change of location. The thread end can subsequently be released again by another suction air pulse, or the thread end which is no longer needed, such as after the knot is tied, can be suctioned off by the new air pulse which again eliminates the clamping of the thread.

Other features which are considered as characteristic for the invention are set forth in the appended claims. Although the invention is illustrated and described herein as embodied in a device for sucking-up and holding a thread, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 4 is a view similar to FIG. 3, at the point in time when the thread is sucked-in.

Figure 1:
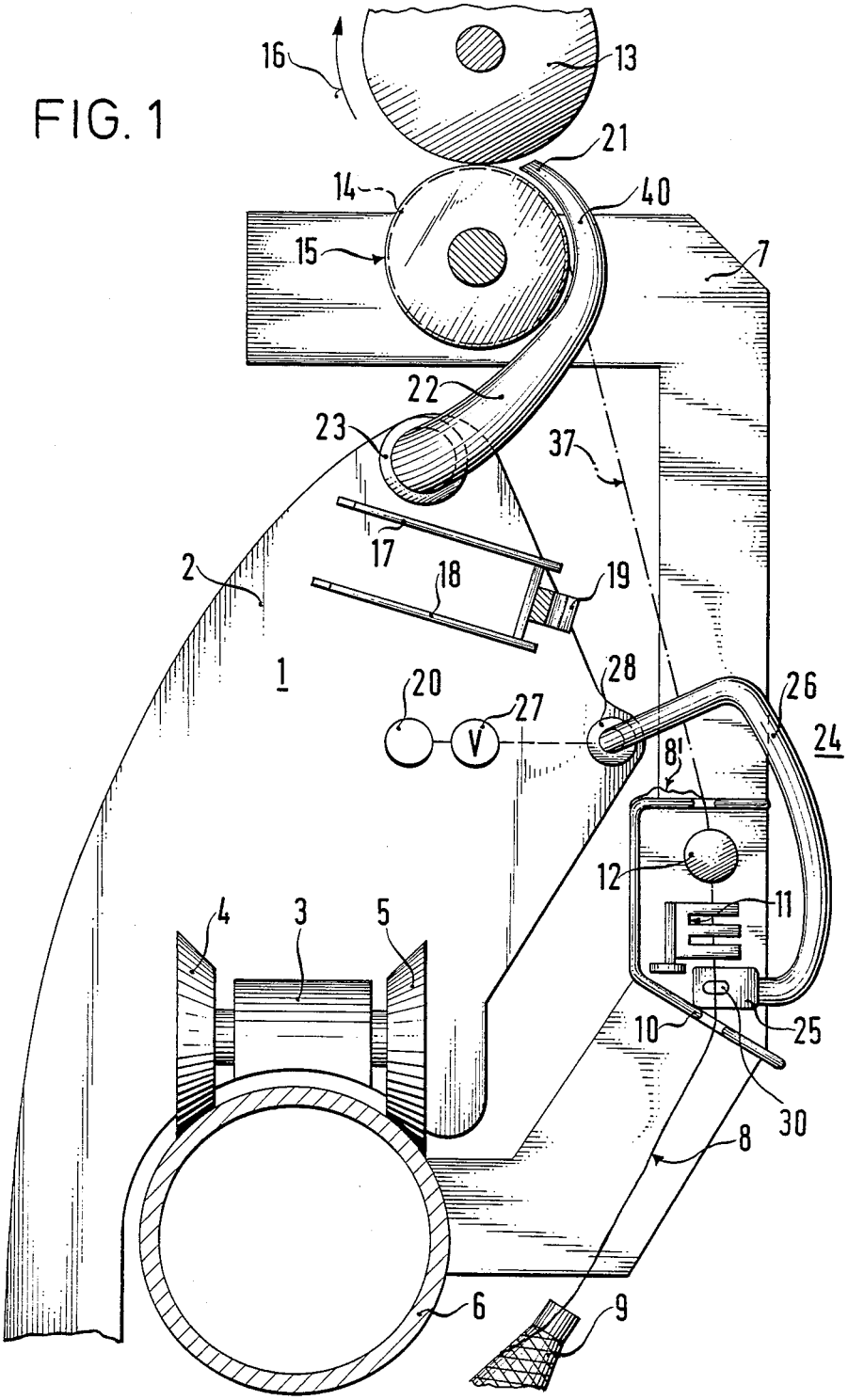
FIG. 1 is a fragmentary, diagrammatic, side elevational and partly cross-sectional view of an automatic thread-tying device, in which the device according to the invention is used.

Referring now in detail to the figures of the drawing, and first particularly to FIG. 1 thereof, there is seen a thread-tying device 1 which has a machine frame 2 with a propulsion drive 3. The propulsion drive 3 has rollers 4 and 5, by means of which the thread-tying device 1 can be moved on a support tube 6. The support tube 6 is disposed alongside a winding machine. Only one stationary winding station 7 of the winding machine is visible in the drawing.

In the case shown, the thread- tying device 1 is operating at the winding station 7.

A thread is guided through a thread guide 10 and a thread guide 11 to a thread brake 12. The thread 8 is broken above the thread brake 12 and forms a thread end 8' at this location.

The thread 8 is to be rejoined to the end of a thread which is already wound on a bobbin 13. The bobbin 13 is supported on a thread-guiding cylinder 15 provided with thread-reversing grooves 14. In normal winding operation, the coil 13 is driven by the thread guiding cylinder 15 in the direction of the arrow 16.

The thread-joining device 1 has two side plates 17, 18 which are fastened to the machine frame 2. A thread-splicing device 19 is fastened to the side plates 17, 18. The thread-joining device 1 furthermore includes a thread suction nozzle 21 which can be connected to a suction air source 20 and can be brought close to the surface of the bobbin 13. The thread suction nozzle 21 has a hollow tilting or swivel arm 22 which also serves to conduct the suction air. The thread suction nozzle 21 is shaped in such a way and its swing motion is set in such a way, that it simultaneously serves as a device for inserting the sucked-in thread into the thread-splicing device 19. A swiveling device 23 serves for swinging the swivel arm 22. A thread-clamping device is not provided at the thread-suction nozzle 21 or at the tilting arm 22.

The thread-joining device 1 further includes a device, which is designated overall with reference numeral 24, for sucking-up and holding a thread. The device 24 has a suction head 25 which is connected through a hollow body 26 to a controllable valve 27 connected to the suction air source 20. The hollow body 26 is constructed in the form of a movable line; more specifically, it is a movable pipeline which can be tilted or swiveled by means of a swiveling device 28.

Figure 3:
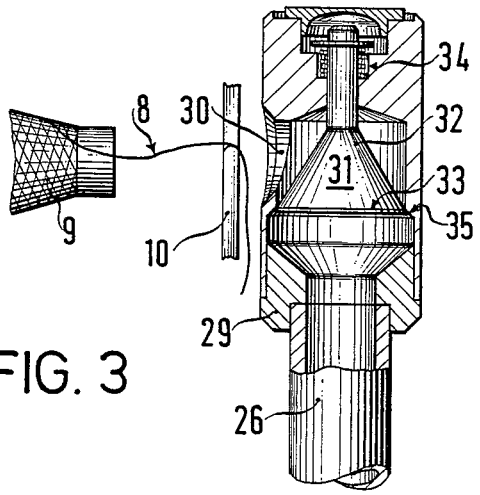
FIG. 3 is a fragmentary, mostly cross-sectional view of the device according to the invention at the point in time when it is ready for operation.
Figure 4:
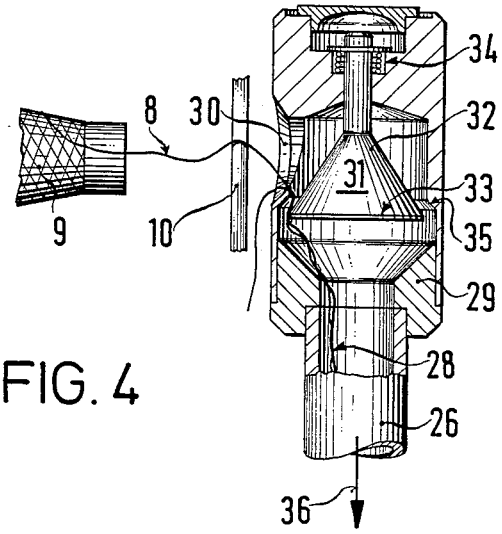

The suction head 24 has a suction opening 30 formed therein, as is shown particularly in FIGS. 3 and 4. In vicinity of the suction opening 30, a thread-clamping device which is formed of a pneumatic valve 31 which responds to underpressure, is provided. The pneumatic valve has a valve disc 32 with a conical shape. The valve cone is tapered against the flow direction. A rim 33 of the valve cone 32 is caused to rest on the lower surface of a valve seat 35 by the force of a spring 34. The valve seat 35 is part of the suction head 25. The spring 34 is constructed in such a way as to allow the valve disc 32 to move downward and to allow its rim 33 to be lifted off the valve seat 35, as soon as suction air flows in the direction of the arrow 36, as is shown in FIG. 4.

The device 24 serves for sucking in and holding the thread 8 coming from an unwinding coil 9, as shown in FIG. 4.

Figure 2:
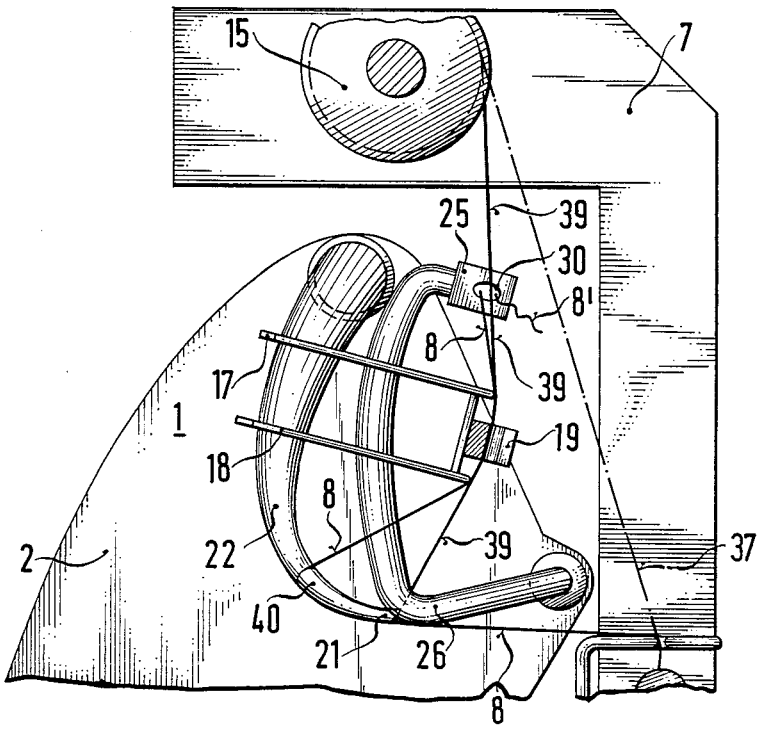
FIG. 2 is a view of a portion of the thread-tying device of FIG. 1, after the thread has been sucked-in while producing a thread joint.

The travelling automatic thread-joining device 1 is responsible for several winding stations and travels in an oscillating movement back and forth on the support tube 6 behind the winding stations, until it is activated upon the request of a winding station. The tilting arm 22 and the hollow body 26 are then in the swung back position as shown in FIG. 2. The undisturbed running of the thread of the winding station 7 is indicated by a dot-dash line 37.

According to FIG. 1, it is assumed that the thread 8 has already lost its connection with the coil 13. To establish a new joint, the swiveling device 28 has swung the hollow body 26 so far that the suction opening 30 of the suction head 25 is next to the thread 8. At the same time, the swiveling device 23 has swung the swivel arm 22 so far that the thread suction nozzle 21 is in vicinity of the surface of the coil 13. The thread suction nozzle 21 is continuously acted upon by suction air, but the suction head 25 is not. The pneumatic valve 31 is therefore closed, as is shown in FIG. 3. The controlled valve 27 is opened for a short time, for sucking-in the thread 8. A pulse-like suction air stream travels through the hollow body 26 in the direction of the arrow 36, so that the pneumatic valve 31 is opened, as shown in FIG. 4. The thread 8 is taken along in the process into the suction opening 30. A thread loop 28 as indicated in FIG. 4, for instance, is formed. The thread end 8' is still being held by the thread brake 12, and otherwise the thread 8 is pulled off the unwinding coil 9.

When the suction air pulse ceases, the pneumatic valve 31 is closed again and the thread loop 28 remains clamped. Up to this point in time, the upper thread 39 is also pulled from the surface of the coil 13 by the thread suction nozzle 21 and has been sucked-in, as shown in FIG. 2. Subsequently, the swivel arm 22 and the hollow body 26 are simultaneously swung back into the starting position shown in FIG. 2. The threads are thus taken along and inserted into the thread splicing device 19, as shown in FIG. 2.

The threads are then joined by splicing; the excess thread ends are cut off near the splice, whereupon the end of the upper thread 39 is immediately sucked into the thread suction nozzle 21. The thread end 8' of the thread 8, on the other hand, is held fast in the suction head 25 until this thread end is also completely suctioned off by another suction air pulse. If the winding tension of the bobbin 13 subsequently resumes, the thread 8 slides down from a shoulder 40 of the thread suction nozzle 21 and then resumes a course which is indicated by the dot-dash line 37.

The invention is not limited to the embodiment shown and described. The simple pneumatic control of the valve 31 by the controlled valve 27 also permits variations in the operation. Thus, a further suction air pulse could be given if the hollow body 26 has travelled half its swing after the thread end 8' has been pulled out of the thread guide or feeler 11 and the thread brake 12. The suction air pulse would then cause the thread end 8' to be suctioned into the hollow body 26.

The valve 27 and the suction air source 20 are constructed in such a way as to permit the sucked-in thread sections to pass through. It is also possible to use the support tube 6 as the suction air source. Thus, the invention is not limited to the embodiment example shown and described.

I claim:

1. Device for sucking-in and holding a thread, comprising a suction body having a suction opening formed therein for sucking-in a thread in a given suction direction, and a controllable thread-clamping device disposed downstream of said suction opening in said given suction direction, said thread-clamping device being in the form of a pneumatic valve disposed in vicinity of said suction opening including a valve seat, and a valve disc being spring-loaded against said valve seat and being lifted off said valve seat by suction air flowing from said valve seat and creating a suction flow through said suction opening and said pneumatic valve for sucking-in the thread and clamping the thread between said valve seat and said valve disc after the suction flow stops and said pneumatic valve is closed.

2. Device according to claim 1, wherein said valve disc is conical and is tapered against the direction of flow of the suction air.

3. Device according to claim 1, wherein said suction body is a suction head in which said suction opening is formed, and said valve seat is part of said suction head.

4. Device according to claim 3, including a suction air source, a controllable valve connected to said suction air source, and a hollow body connected from said controllable valve to said suction head.

5. Device according to claim 4, wherein said hollow body is a movable line.

6. Device according to claim 5, wherein said movable line is a swivelable pipeline.

7. Device according to claim 1 including an automatic thread-joining device, said suction body and controllable thread-clamping device being part of said automatic thread-joining device.

* * * * *